US008024193B2

(12) United States Patent
Bellegarda

(10) Patent No.: US 8,024,193 B2
(45) Date of Patent: Sep. 20, 2011

(54) METHODS AND APPARATUS RELATED TO PRUNING FOR CONCATENATIVE TEXT-TO-SPEECH SYNTHESIS

(75) Inventor: Jerome R. Bellegarda, Los Gatos, CA (US)

(73) Assignee: Apple inc., Cupertino, CA (US)

( * ) Notice: Subject to any disclaimer, the term of this patent is extended or adjusted under 35 U.S.C. 154(b) by 644 days.

(21) Appl. No.: 11/546,222

(22) Filed: Oct. 10, 2006

(65) Prior Publication Data

US 2008/0091428 A1 Apr. 17, 2008

(51) Int. Cl.
*G10L 13/00* (2006.01)

(52) U.S. Cl. ..... 704/269; 704/258; 704/260

(58) Field of Classification Search ..... 704/254, 704/245, 258–269

See application file for complete search history.

(56) References Cited

U.S. PATENT DOCUMENTS

| | | | | |
|---|---|---|---|---|
| 4,181,821 | A * | 1/1980 | Pirz et al. | 704/252 |
| 4,839,853 | A | 6/1989 | Deerwester et al. | |
| 5,067,158 | A | 11/1991 | Arjmand | |
| 5,485,543 | A | 1/1996 | Aso | |
| 5,675,819 | A * | 10/1997 | Schuetze | 704/10 |
| 6,141,644 | A * | 10/2000 | Kuhn et al. | 704/273 |
| 6,144,939 | A * | 11/2000 | Pearson et al. | 704/258 |
| 7,409,347 | B1 | 8/2008 | Bellegarda | |
| 7,428,541 | B2 * | 9/2008 | Houle | 1/1 |
| 7,643,990 | B1 | 1/2010 | Bellegarda | |
| 2004/0059577 | A1 * | 3/2004 | Pickering | 704/260 |
| 2005/0182629 | A1 | 8/2005 | Coorman et al. | |

OTHER PUBLICATIONS

Rabiner, L. and Juang, B. "Fundamentals of Speech Recognition." Prentice Hall, New Jersey, 1993. pp. 183-190, 267-274.*

Schluter, R. and Ney, H. "Using Phase Spectrum Information for Improved Speech Recognition Performance." IEEE, 2001.*

Nakagawa, S. et al. "Speaker Recognition by Combining MFCC and Phase Information." Interspeech 2007 8th Annual Conference of the International Speech Communication Association; Antwerp, Belgium; Aug. 27-31, 2007.*

(Continued)

*Primary Examiner* — Talivaldis Ivars Smits
*Assistant Examiner* — Shaun Roberts
(74) *Attorney, Agent, or Firm* — Blakely, Sokoloff, Taylor & Zafman LLP

(57) ABSTRACT

The present invention provides, among other things, automatic identification of near-redundant units in a large TTS voice table, identifying which units are distinctive enough to keep and which units are sufficiently redundant to discard. According to an aspect of the invention, pruning is treated as a clustering problem in a suitable feature space. All instances of a given unit (e.g. word or characters expressed as Unicode strings) are mapped onto the feature space, and cluster units in that space using a suitable similarity measure. Since all units in a given cluster are, by construction, closely related from the point of view of the measure used, they are suitably redundant and can be replaced by a single instance. The disclosed method can detect near-redundancy in TTS units in a completely unsupervised manner, based on an original feature extraction and clustering strategy. Each unit can be processed in parallel, and the algorithm is totally scalable, with a pruning factor determinable by a user through the near-redundancy criterion. In an exemplary implementation, a matrix-style modal analysis via Singular Value Decomposition (SVD) is performed on the matrix of the observed instances for the given word unit, resulting in each row of the matrix associated with a feature vector, which can then be clustered using an appropriate closeness measure. Pruning results by mapping each instance to the centroid of its cluster.

102 Claims, 7 Drawing Sheets

OTHER PUBLICATIONS

Murty, K.S.R.; Yegnanarayana, B. "Combining Evidence from Residual Phase and MFCC features for Speaker Recognition." IEEE Signal Processing Letters; 2006.*

Bulyko, Ivan and Ostendorf, Mari. "Joint Prosody Prediction and Unit Selection for Contatenative Speech Snythesis," Electrical Engineering Department, University of Washington, Seattle, WA (4 pages), Oct. 10, 2006.

Cawley, Gavin C. "The Applicaton of Neural Networks to Phonetic Modeling," PhD Thesis (University of Essex web page document [2 pages] and Chapter 1 of PhD Thesis [pp. 21-31]), 1996.

Zovato, Enrico et al. "Towards Emotional Speech Synthesis: A Rule Based Approach," Loquendo S.p.A, Vocal Technology and Services, Turin, Italy (2 pages), Oct. 10, 2006.

Black, Alan W. and Taylor, Paul. "Automatically Clustering Similar Units for Unit Selection in Speech Synthesis," Centre for Speech Technology Research, University of Edinburgh, Edinburgh, U.K. (1997), 4 pages.

Kominek, John and Black, Alan W. "Impact of Durational Outlier Removal from Unit Selection Catalogs," Language Technologies Institute, Carnegie Mellon University, 5th ISCA Speech Synthesis Workshop—Pittsburgh (Jun. 14-16, 2004), pp. 155-160.

Bellegarda, J.R., "Exploiting Latent Semantic Information in Statistical Language Modeling," Proc. IEEE, vol. 88, No. 8, pp. 1279-1296, Aug. 2000.

"FIR Filter Properties," dsp Guru by Iowegian International, Digital Signal Processing Central, accessed Jul. 28, 2010 at http://www.dspguru.com/dsp/faqs/fir/properties, 6 pages, best available copy.

Logan, Beth, "Mel Frequency Cepstral Coefficients for Music Modeling," Cambridge Research Laboratory, Compaq Computer Corporation, before Apr. 13, 2011, 2 pages, best available copy.

Sigurdsson, Sigurdur, et al., "Mel Frequency Cepstral Coefficients: An Evaluation of Robustness of MP3 Encoded Music," Technical University of Denmark, 2006, 4 pages, best available copy.

Wikipedia, "Mel Scale," accessed Jul. 28, 2010 at http://www.wikipedia.org/wiki/Mel_scale, 2 pages, best available copy.

Wikipedia, "Minimum phase," accessed Jul. 28, 2010 at http://www.wikipedia.org/wiki/Minimum_phase, 8 pages, best available copy.

* cited by examiner

METHODS AND APPARATUS RELATED TO PRUNING FOR CONCATENATIVE TEXT-TO-SPEECH SYNTHESIS

FIELD OF THE INVENTION

The present invention relates generally to text-to-speech synthesis, and in particular, in one embodiment, relates to concatenative speech synthesis.

BACKGROUND OF THE INVENTION

A text-to-speech synthesis (TTS) system converts text inputs (e.g. in the form of words, characters, syllables, or mora expressed as Unicode strings) to synthesized speech waveforms, which can be reproduced by a machine, such as a data processing system. A typical text-to-speech synthesis system consists of two components, a text processing step to convert the text input into a symbolic linguistic representation, and a sound synthesizer to convert the symbolic linguistic representation into actual sound output. The text processing step typically assigns phonetic transcriptions to each word, and divides the text input into various prosodic units. The combination of the phonetic transcriptions and the prosodic information creates the symbolic linguistic representation for the text input.

There are two main synthesizer technologies for generating synthetic speech waveforms. Concatenative synthesis is based on the concatenation of segments of recorded speech. Concatenative synthesis generally gives the most natural sounding synthesized speech. The other synthesizer technology is formant synthesis where the output synthesized speech is generated using an acoustic model employing time-varying parameters such as fundamental frequency, voicing, and noise level. There are other synthesis methods such as articulatory synthesis based on computational model of the human vocal tract, hybrid synthesis of concatenative and formant synthesis, and Hidden Markov Model (HMM)-based synthesis.

In concatenative text-to-speech synthesis, the speech waveform corresponding to a given sequence of phonemes is generated by concatenating pre-recorded segments of speech. These segments are often extracted from carefully selected sentences uttered by a professional speaker, and stored in a database known as a voice table. Each such segment is typically referred to as a unit. A unit may be a phoneme, a diphone (the span between the middle of a phoneme and the middle of another), or a sequence thereof. A phoneme is a phonetic unit in a language that corresponds to a set of similar speech realizations (like the velar \k\ of cool and the palatal \k\ of keel) perceived to be a single distinctive sound in the language.

In a typical concatenative synthesis system, a text phrase input is first processed to convert to an input phonetic data sequence of a symbolic linguistic representation of the text phrase input. A unit selector then retrieves from the speech segment database (voice table) descriptors of candidate speech units that can be concatenated into the target phonetic data sequence. The unit selector also creates an ordered list of candidate speech units, and then assigns a target cost to each candidate. Candidate-to-target matching is based on symbolic feature vectors, such as phonetic context and prosodic context, and numeric descriptors, and determines how well each candidate fits the target specification. The unit selector determines which candidate speech units can be concatenated without causing disturbing quality degradations such as clicks, pitch discontinuities, etc., based on a quality degradation cost function, which uses candidate-to-candidate matching with frame-based information such as energy, pitch and spectral information to determine how well the candidates can be joined together. The job of the selection algorithm is to find units in the database which best match this target specification and to find units which join together smoothly. The best sequence of candidate speech units is selected for output to a speech waveform concatenator. The speech waveform concatenator requests the output speech units (e.g. diphones and/or polyphones) from the speech unit database. The speech waveform concatenator concatenates the speech units selected forming the output speech that represents the input text phrase.

The quality of the synthetic speech resulting from concatenative text-to-speech (TTS) synthesis is heavily dependent on the underlying inventory of units, i.e. voice table database. A great deal of attention is typically paid to issues such as coverage (i.e. whether all possible units are represented in the voice table), consistency (i.e. whether the speaker is adhering to the same style throughout the recording process), and recording quality (i.e. whether the signal-to-noise ratio is as high as possible at all times).

The issue of coverage is particularly salient, because of the inevitable degradation which is suffered when substituting an alternative unit for the optimal one when the latter is not present in the voice table. The availability of many such unit candidates can permit prosodic and other linguistic variations in the speech output stream. Achieving higher coverage usually means recording a larger corpus, especially when the basic unit is polyphonic, as in the case of words. Voice tables with a footprint close to 1 GB are now routine in server-based applications. The next generation of TTS systems could easily bring forth an order of magnitude increase in the size of the typical database, as more and more acoustico-linguistic events are included in the corpus to be recorded. The following prior art describes speech synthesis systems: U.S. Patent Application Publication No. 2005/0182629; Impact of Durational Outliers Removal from Unit Selection Catalogs, by John Kominek and Alan W. Black, 5$^{th}$ ISCA Speech Synthesis Workshop, Pittsburgh; *Automatically Clustering Similar Units for Unit Selection in Speech Synthesis*, by Alan W. Black and Paul Taylor, 1997.

Unfortunately, such large sizes are not practical for deployment in certain data processing environments. Even after applying standard file compression techniques, the resulting TTS system may be too big to ship as part of the distribution of a software package, such as an operating system.

It would therefore be desirable to develop a totally unsupervised, fully scalable pruning solution for a voice table for reducing the size of the database while maintaining coverage.

SUMMARY OF THE DESCRIPTION

The present invention discloses, among other things, methods and apparatuses for pruning for concatenative text-to-speech synthesis, and in one embodiment, the pruning is scalable, automatic and unsupervised. A pruning process according to an embodiment of the present invention comprises automatic identification of redundant or near-redundant units in a large TTS voice table, identifying which units are distinctive enough to keep and which units are sufficiently redundant to discard. In an embodiment, a scalable automatic offline unit pruning is provided. In another embodiment, unit pruning is based on a machine perception transformation conceptually similar to a human perception. For example, the machine perception transformation may take both frequency and phase into account when determining whether units are redundant.

According to an embodiment of the invention, pruning is treated as a clustering problem in a suitable feature space. In this embodiment, all instances of a given unit (e.g. word unit) may be mapped onto the feature space, and the units are clustered in that space using a suitable similarity measure. Since all units in a given cluster are, by construction, closely related from the point of view of the measure used, they are suitably redundant and can be replaced by a single instance.

The disclosed method can detect near-redundancy in TTS units in a completely unsupervised manner, based on an original feature extraction and clustering strategy, which may use factors such as both frequency and phase when determining whether units are redundant. Each unit can be processed in parallel, and the algorithm is totally scalable, with a pruning factor determinable by a user through the near-redundancy criterion.

In an exemplary implementation, the time-domain samples corresponding to all observed instances are gathered for the given word unit. This forms a matrix where each row corresponds to a particular instance present in the database. A matrix-style modal analysis via Singular Value Decomposition (SVD) is performed on the matrix. Each row of the matrix (e.g., instance of the unit) is then associated with a vector in the space spanned by the left and right singular matrices. These vectors can be viewed as feature vectors, which can then be clustered using an appropriate closeness measure. Pruning results by mapping each instance to the centroid or other locus of its cluster.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DETAILED DESCRIPTION

Methods and apparatuses for pruning for text-to-speech synthesis are described herein. According to one, the present invention discloses, among other things, a methodology for pruning of redundant or near-redundant voice samples in a voice table based on a machine perception transformation that is conceptually similar to human perception, and this pruning may be scalable, automatic and/or unsupervised. In an embodiment of the present invention, redundancy criterion is established by the similarity of the voice sample parameters based on a machine perception transformation that is compatible with human perception. Thus an exemplary redundancy pruning process comprises transforming the voice samples in a voice table into a set of machine perception parameters, then comparing and removing the voice samples exhibiting similar perception parameters, which may include both frequency and phase information. Another exemplary redundancy pruning process comprises clustering the voice samples on a machine perception space, then removing the voice samples clustering around a cluster centroid or other locus, keeping only the centroid sample.

In the following detailed description of embodiments of the invention, reference is made to the accompanying drawings in which like references indicate similar elements, and in which is shown by way of illustration specific embodiments in which the invention may be practiced. These embodiments are described in sufficient detail to enable those skilled in the art to practice the invention, and it is to be understood that other embodiments may be utilized and that logical, mechanical, electrical, functional, and other changes may be made without departing from the scope of the present invention. The following detailed description is, therefore, not to be taken in a limiting sense, and the scope of the present invention is defined only by the appended claims.

Figure 1:
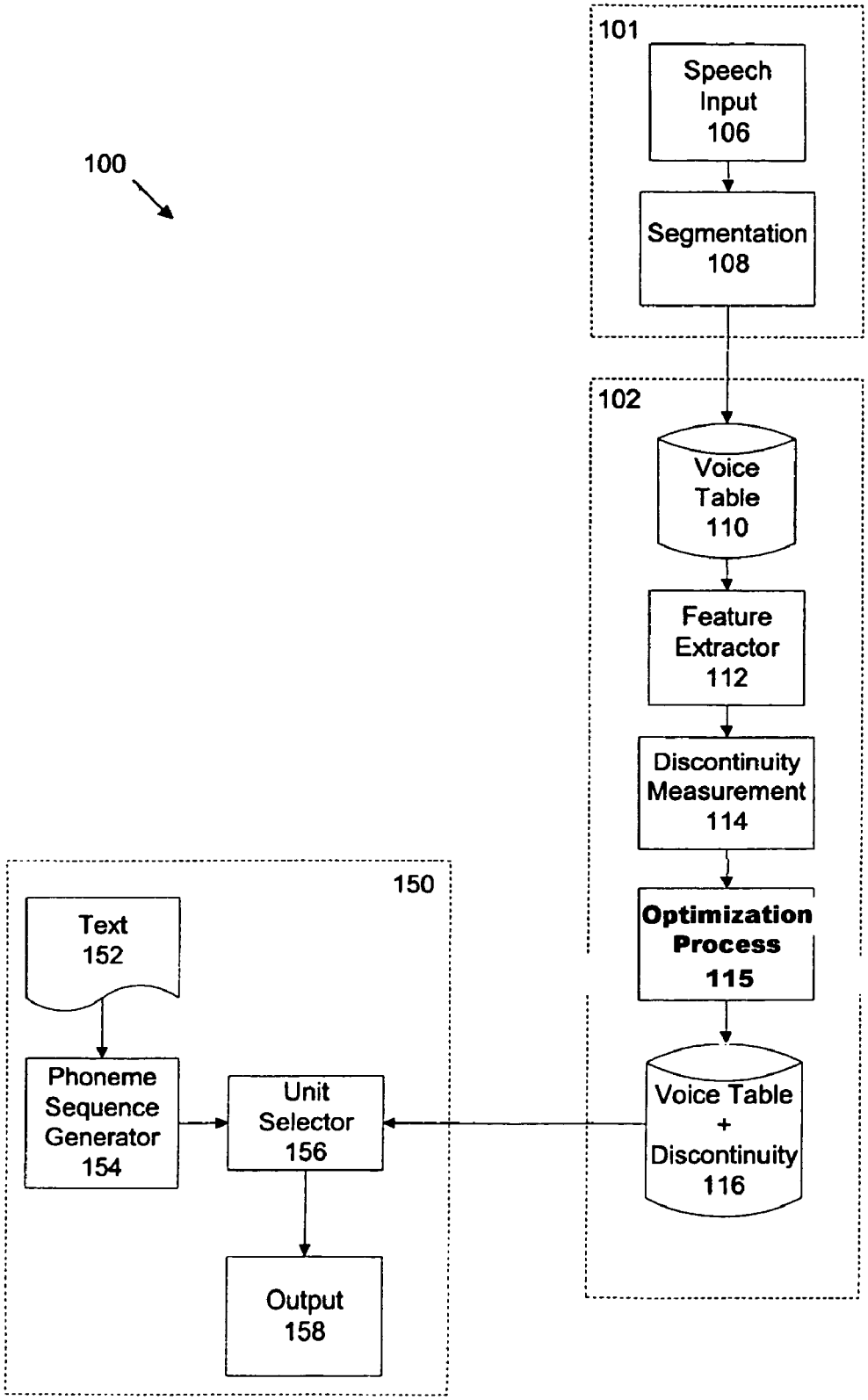
FIG. 1 illustrates a system level overview of an embodiment of a text-to-speech (TTS) system

FIG. 1 illustrates a system level overview of an embodiment of a text-to-speech (TTS) system 100 which produces a speech waveform 158 from text 152, and which may be a concatenative TTS system. TTS system 100 includes three components: a segmentation component 101, a voice table component 102 and a run-time component 150. Segmentation component 101 divides recorded speech input 106 into segments for storage in a raw voice table 110. Voice table component 102 handles the formation of an optimized voice table 116 with discontinuity information. Run-time component 150 handles the unit selection process, from a pruned voice table, during text-to-speech synthesis.

Recorded speech from a professional speaker is input at block 106. The speech may be a user's own recorded voice, which may be merged with an existing database (after suitable processing) to achieve a desired level of coverage. The recorded speech is segmented into units at segmentation block 108.

Segmentation refers to creating a unit inventory by defining unit boundaries; i.e. cutting recorded speech into segments. Unit boundaries and the methodology used to define them influence the degree of discontinuity after concatenation, and therefore, the degree to which synthetic speech sounds natural. Unit boundaries can be optimized before applying the unit selection procedure so as to preserve contiguous segments while minimizing poor potential concatenations. Contiguity information is preserved in the raw voice table 110 so that longer speech segments may be recovered. For example, where a speech segment S1-R1 is divided into two segments, S1 and R1, information is preserved indicating that the segments are contiguous; i.e. there is no artificial concatenation between the segments.

After segmentation, a raw voice table 110 is generated from the segments produced by segmentation block 108. In another embodiment, the raw voice table 110 can be a pre-generated voice table that is provided to the system 100.

Feature extractor 112 mines voice table 110 and extracts features from segments so that they may be characterized and compared to one another. Once appropriate features have been extracted from the segments stored in voice table 110, discontinuity measurement block 114 computes a discontinuity between segments. Discontinuity measurements for each segment are then added as values to the voice table 110. Further details of discontinuity information may be found in co-pending U.S. patent application Ser. No. 10/693,227, entitled "Global Boundary-Centric Feature Extraction and Associated Discontinuity Metrics," filed Oct. 23, 2003, and U.S. patent application Ser. No. 10/692,994, entitled "Data-Driven Global Boundary Optimization," filed Oct. 23, 2003, both assigned to Apple Computer, Inc., the assignee of the present invention, and which are hereby incorporated herein by reference. An optimization process 115 can be applied to the voice table 110 to form an optimized voice table 116. Optimization process 115 can comprise the removal of bad units, outlier removal or redundancy or near-redundancy removal as disclosed by embodiments of the present invention. The optimization of the present invention provides an off-line redundancy or near-redundancy pruning of the voice table. Off-line optimization is referred to as automatic pruning of the unit inventory, in contrast to the on-line run-time "decoding" process embedded in unit selection. Vector quantization can also be applied during optimization. Vector quantization is a process of taking a large set of feature vectors and producing a smaller set of feature vectors that represent the centroid or locus of the distribution.

Run-time component 150 handles the unit selection process. Text 152 is processed by the phoneme sequence generator 154 to convert text (e.g. words, characters, syllables, or mora in the form of ASCII or other encodings) to phoneme sequences. Text 152 may originate from any of several sources, such as a text document, a web page, an input device such as a keyboard, or through an optical character recognition (OCR) device. Phoneme sequence generator 154 converts the text 152 into a string of phonemes. It will be appreciated that in other embodiments, phoneme sequence generator 154 may produce strings based on other suitable divisions, such as diphones, syllables, words or sequences.

Unit selector 156 selects speech segments from the voice table 116, which may be a table pruned through one of the embodiments of the invention, to represent the phoneme string. The unit selector 156 can select voice segments or discontinuity information segments stored in voice table 116. Once appropriate segments have been selected, the segments are concatenated to form a speech waveform for playback by output block 158. In one embodiment, segmentation component 101 and voice table component 102 are implemented on a server computer, or on a computer operated under control of a distributor of a software product, such as a speech synthesizer which is part of an operating system, such as the Mac OS operating system, and the run-time component 150 is implemented on a client computer, which may include a copy of the pruned table.

In concatenative text-to-speech (TTS) synthesis, the quality of the resulting speech is highly dependent on the underlying inventory of units in the voice table. Achieving higher coverage usually means recording a larger corpus, resulting in a larger voiceprint footprint.

This is a widespread problem in concatenative text-to-speech (TTS) synthesis. To attain sufficient coverage, this system relies on a very large corpus of utterances designed to include most relevant acoustico-linguistic events. Because of the lopsided sparsity inherent to natural language, this leads to some near-redundancy among certain common sequences of units. To illustrate, a current voice table includes about 65 hours of speech. Without pruning, this would translate into roughly 10 GB worth of uncompressed voice table. Clearly, pruning may be desirable in at least certain data processing environments.

Without pruning, a high quality voice table may be too big to ship as part of a software distribution, even after applying standard file compression techniques. The present invention discloses solutions which make it possible to reduce the footprint to a manageable size, while incurring minimal impact on the smoothness and naturalness of the voice. The outcome is that a voice trained on 65 hours of speech can be made available in a desktop environment, or other data processing environments such as a cellular telephone. The comprehensiveness of the voice table, implemented through a disclosed pruning technique offers a perceptively better voice quality compared to other computer systems.

This issue is especially critical in word-based concatenation systems, such as the next generation Apple MacinTalk system, because the more polyphonic the basic unit, the larger the number of acoustico-linguistic events to be collected to attain sufficient coverage. Because of the lopsided sparsity inherent to natural language, larger corpus intrinsically exhibits a higher level of redundancy among common sequences of units. For example, expanding a given corpus to include the event "Caldecott medal?" (spoken at the end of a question) might result in the sequence "who won the" being collected as well, a similar rendition of which may already be present in the corpus from the previously recorded sentence "who won the Nobel prize?". Thus the unfortunate consequence of expanding coverage of rare events typically entails near duplication of frequent events. Not only does this needlessly bloat the database, but it also complicates the task of the unit selection algorithm, as it must often divert resources from cases that really matter to distinguish between units which differ little.

In order to keep the size of the voice table manageable, it is therefore desirable in at least certain embodiments to identify which units are distinctive enough to keep and which units are sufficiently redundant to discard.

Of course, deciding a priori which units are likely to be perceived as interchangeable, and are therefore good candidates for pruning is not trivial. Over the years, different strategies have evolved. For example, in diphone synthesis, this was done largely on the basis of listening. The pruning criterion in this case is usually the perception of the sound, listened to by an operator, who then decides the similarity between different voice segment units. In diphone synthesis, the number of diphone units is small enough (e.g. about 2000 in English) to enable manual pruning. In contrast, polyphone synthesis allows multiple instances of every unit. Due to the much larger size of the unit inventory, manually pruning unit redundancy is extremely time consuming and expensive. Thus the major drawback of manual pruning is a lack of scalability and the need for human supervision, which is obviously impractical to do at the word level.

Figure 2:
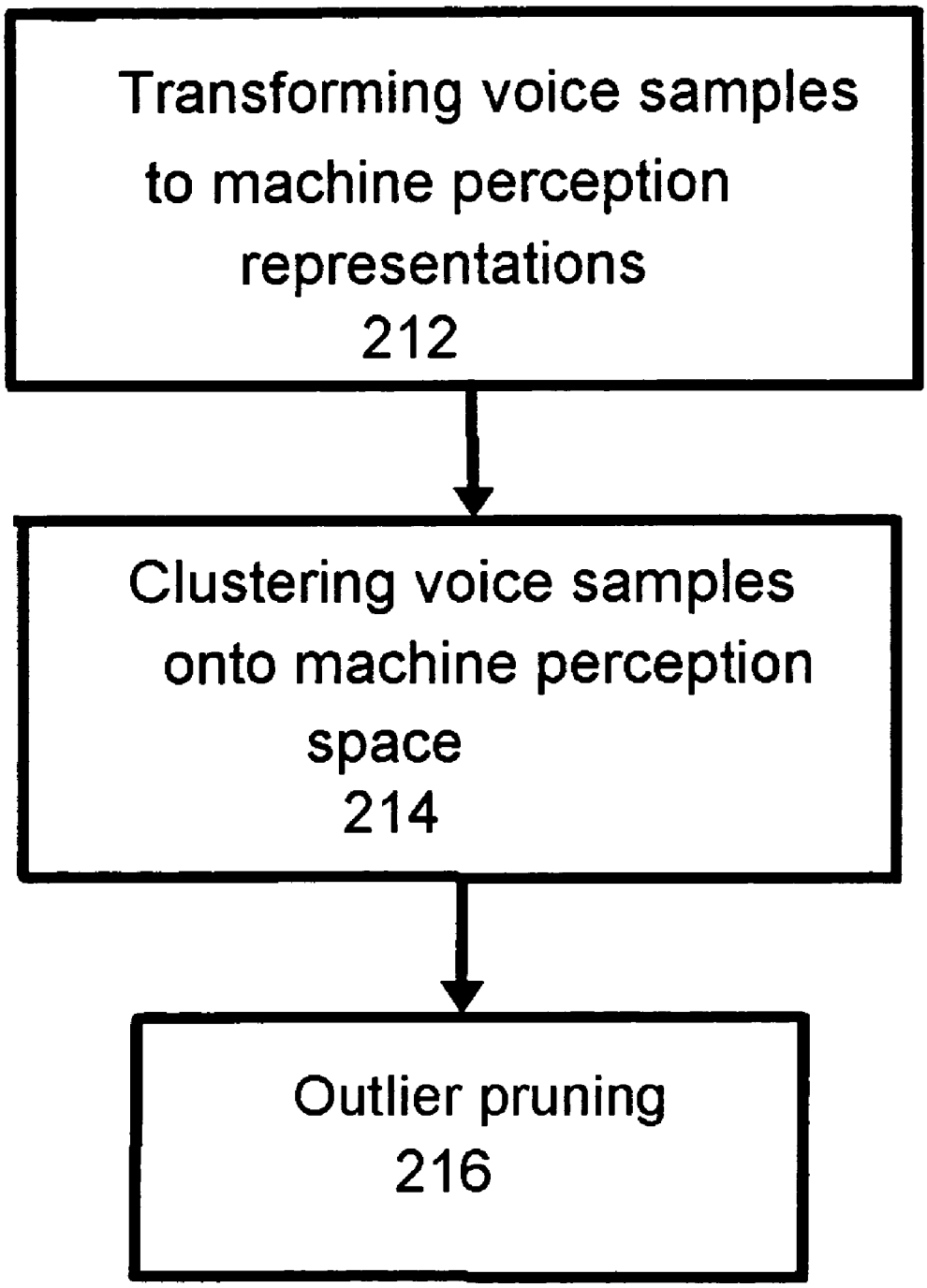
FIG. 2 shows a prior art outlier removal process.
Figure 3:
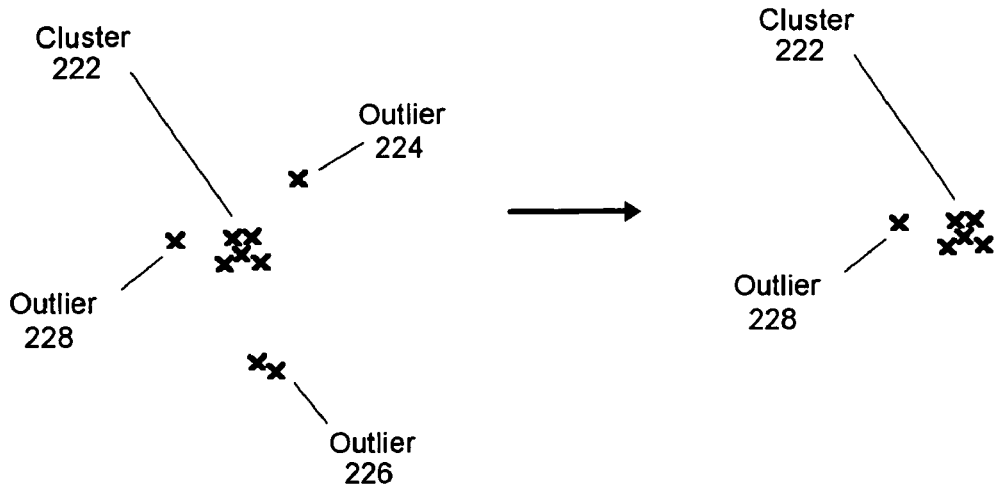
FIG. 3 shows a prior art outlier removal concept.

On the other hand, automatic pruning process for removing bad units has been developed based on clustering technique. FIG. 2 shows a flow chart representing the steps of a typical prior art clustering technique for outlier removal. In step 212, a representation is selected to represent the perception of sound. Then in step 214, the units of the same type in the voice table is mapped onto this representation space, which represents the sound perception space, which in this case is frequency only. The units are clustered together in this space, and in step 216, units from the furthest cluster center are pruned from the voice table, under the assumption that they are not conformed to the normal distribution, and thus are likely to be bad units. FIG. 3 shows a conceptual outlier removal of the voice sample units in a machine perception space. Units are mapped onto a cluster 222, with various outlier units 224, 226 and 228. Pruning is then performed to remove the outliers units 224 and 226. Outlier unit 228 may or may not be removed based on the pruning similarity criterion.

Prior art outlier removal is thus a straightforward technique for removing the units that are furthest from the cluster center.

For example, one criterion for sound clustering is phone durational measure, with the assumption is that unusually short or unusually long units are most likely bad units, and thus removing such durational outliers will be beneficial. However, in certain cases, durational outliers are critical for the complete coverage of the voice table, and thus the benefit resulting from outlier removal is not guaranteed. Further, excessive outlier removal could result in more prosodically constrained or more average sounding, since many voice differences have been removed after being labeled as outliers.

Even prior art pruning claiming to remove overly common units which have no significant distinction between the units can be seen as another instance of outlier removal. The typical approach only deals with the most common unit types, and involves looking at the distribution of the distances within clusters for each unit type: if the distances are "far enough", the units furthest from the cluster center are removed.

Another approach has been to synthesize large amounts of material and keep track of those units that get selected most often, on the theory that they are the most relevant. A disadvantage of this approach is the inherent bias induced by the choice of material, since the resulting voice table after pruning is heavily dependent on the choice of material considered. Synthesizing with a different source of text may well result in different units being selected, and hence a different pruning scheme. In addition, this technique is not really scalable to the word level of word-based concatenation due to the excessive number of units involved, as it would require enough text material that every word in the voice table could appear multiple times, which is impractical for even moderate size vocabularies.

A possible explanation for the apparent difficulty in prior art pruning technique is the inherent difference between the human perception and machine perception of sound. Obviously, human perception is the final arbiter of sound redundancy. However, for unsupervised or automatic assessment of the voice table, the voice segment units are judged by machine perception, which is based a set of measurable physical quantities of the voice units.

Machine perception requires a quantitative characterization of sound perception. Therefore the perceptual quality of a sound unit in the voice table is usually converted to physical quantities. For examples, pitch is represented by fundamental frequency of the sound waveform; loudness is represented by intensity; timber is represented by spectral shape; timing is represented by onset or offset time; and sound location is represented by phase difference for binaural hearing, etc. The sound units may then mapped onto a sound perception space, with a sound perception distance between the sound units.

Although the machine perception of sound, and therefore the quality of corpus-based speech synthesis systems is often very good, there is a large variance in the overall speech quality. This is mainly because the machine perception transformation is only an approximation of a complex perceptual process. Basically, machine perception can be considered only adequate for distinguishing voice units that are far apart. Voice units that are close together, identical or nearly identical in machine perception space could be not the same in human perception space. Thus prior art clustering technique can be quite practical at outlier removal, but not at redundancy removal.

A popular machine perception space is Mel frequency cepstral coefficients. A speech signal is split into overlapping frames, each about 10-20 ms long. For each frame, the speech signal is then typically convoluted with a certain filter, for examples, an impulse response of an interference with speech information. The resulting signal is Fourier transformed, and then converted to a scale (for example, Mel scale). The converted transformation is again inverse Fourier transform to become the cepstrum of the sound signal.

The Mel scale translates regular frequencies to a scale that is more appropriate for speech, since the human ear perceives sound in a nonlinear manner. The first twelve Mel cepstral coefficients are common used to describe the speech signal. To describe the voice signal further, beside the absolute spectral measurements (Mel spaced cepstral coefficients, derived from cepstral analysis), other variables can be included, such as energy and delta energy (derived from the signal), first derivative to denote rate of change of the voice (derived from first time derivative of the signal), and second derivative to denote the acceleration of the voice (derived from first time derivative of the signal).

Current transformations only take into account the frequency spectrum of the signal, and discard the phase information. Indeed, conventional wisdom teaches that phase information is not useful in a machine perception space.

Figure 4:
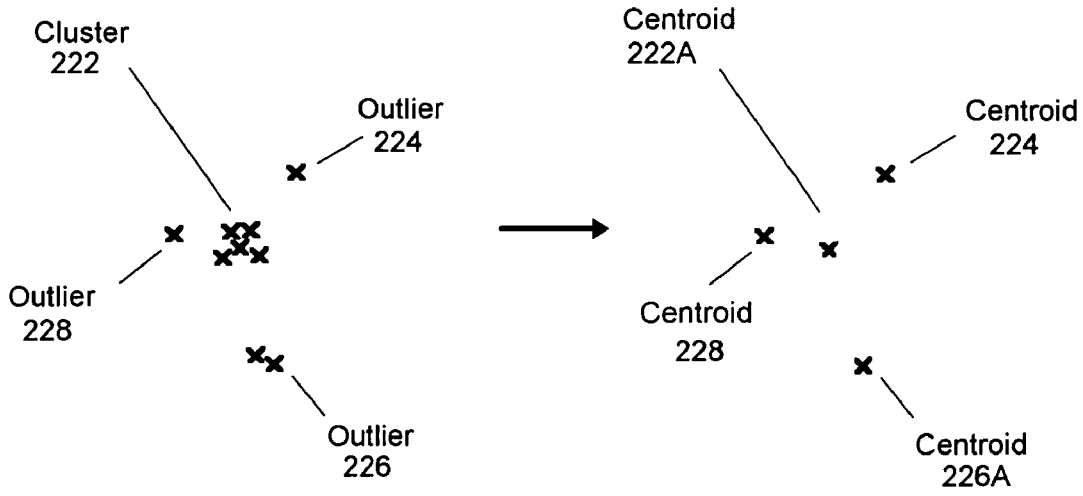
FIG. 4 shows an embodiment of the present invention which utilizes redundancy pruning.

FIG. 4 shows an embodiment of redundancy pruning of the present invention. The original set of units in the left side of FIG. 4 is the same as the original set of units on the left side of FIG. 3. The right side of FIG. 3 shows the result of outlier removal, and the right side of FIG. 4 shows an example of the result of redundancy pruning using an embodiment of the present invention. In the prior art, outlier units 224 and 226 are removed, but in this example the present invention maintains the presence of these outlier units. The redundancy pruning is performed by replacing the units within the cluster 222 with a cluster centroid 222A, as shown in FIG. 4. Similarly, the outlier cluster 226 is redundantly pruned to become 226A, and the outlier units 224 and 228 stay the same, as shown in FIG. 4. Alternatively, for larger radius of redundancy, the cluster 222 may include the outlier 228, and instead of having two centroids 222A and 228, there is only one centroid 222A covering also the outlier 228. Thus the redundancy pruning according to an aspect of the present invention can be entirely under user control.

In an embodiment, the present invention discloses that the incorporation of phase information to the perception of sound signal is needed, at least for redundancy or near-redundancy pruning of the voice table. With the incorporation of phase information, the machine perception can be closer to human perception, and therefore the concept of removing redundancy or near-redundancy is possible, since two signals close in machine representation are also close in human perception, and therefore one can be removed without much loss in voice table quality.

In an aspect of the present invention, redundancy pruning is performed on a voice table, e.g. if there are two voice samples having similar representations through a machine perception space, one is removed from the voice table. The similarity measure or the proximity criterion is a user's predetermined factor, which provides a tradeoff between high prunings for smaller voice table versus low pruning for minimized voice table degradation.

In another embodiment, the present invention discloses an approach to pruning as a clustering problem in a suitable feature space. The idea is to map all instances of a particular voice (e.g. word) unit onto an appropriate feature space, and cluster units in that space using a suitable similarity measure. Since all units in a given cluster are closely related from the point of view of the measure used, and since the machine perception space used is closely related to the human perception space, these units in a given cluster are redundant or near-redundant and can be replaced by a single instance. This induces pruning by a factor equal to the average number of instances in each cluster, which is represented by the cluster radius. Though this strategy is applicable to any type of unit, it is of particular interest in the context of word-based concatenation, because of the limitations on conventional techniques evoked above. The disclosed method detects near-redundancy in TTS units in a completely unsupervised manner, based on an original feature extraction and clustering strategy. Each unit can be processed in parallel, and the algorithm is totally scalable.

The present invention in at least certain embodiments removes only redundancy, or near-redundancy per user's similarity measure criterion, and therefore theoretically do not degrade the quality of the voice table because of the voice sample removal. The criterion of redundancy is therefore related to the quality of the voice table, in exchange for its size. For best quality of the voice table, perfect or near perfect redundancy is employed, meaning the voice samples have to be identical or near identical before being removed from the voice table. This approach preserves the best quality for the voice table, at the expense of a large size. This tradeoff is a user's determined factor, thus if a smaller voice table is required, a looser criterion for redundancy can be performed, where the radius of redundancy cluster can be enlarged. This way, almost-redundancy or somewhat-redundancy can be performed, meaning almost identical or somewhat identical voice samples are removed from the voice table.

In contrast to prior art outlier removal which could introduce artifact by removing outliers which are perfectly legitimate, the present invention redundancy removal does not compromise the voice table since only redundancy (according to a user's specification) is removed from the voice table. In the present invention, outliers are treated as legitimate voice samples, with the only pruning action based on the samples' redundancy. In an aspect of the invention, outlier removal process to remove bad units can be included.

In a preferred embodiment, the machine perception mapping according to the present invention is compatible or correlated with the human perception. An adequate perception mapping renders the proximity in the machine perception space to be equivalent to the proximity in human perception space. In another embodiment, the present invention discloses a perception mapping that comprises the phase information of the voice samples, for examples, transformations comprising frequency and phase information, matrix transformations that reveal the rank of the matrix, or non-negative matrix factorization transformations.

Figure 5:
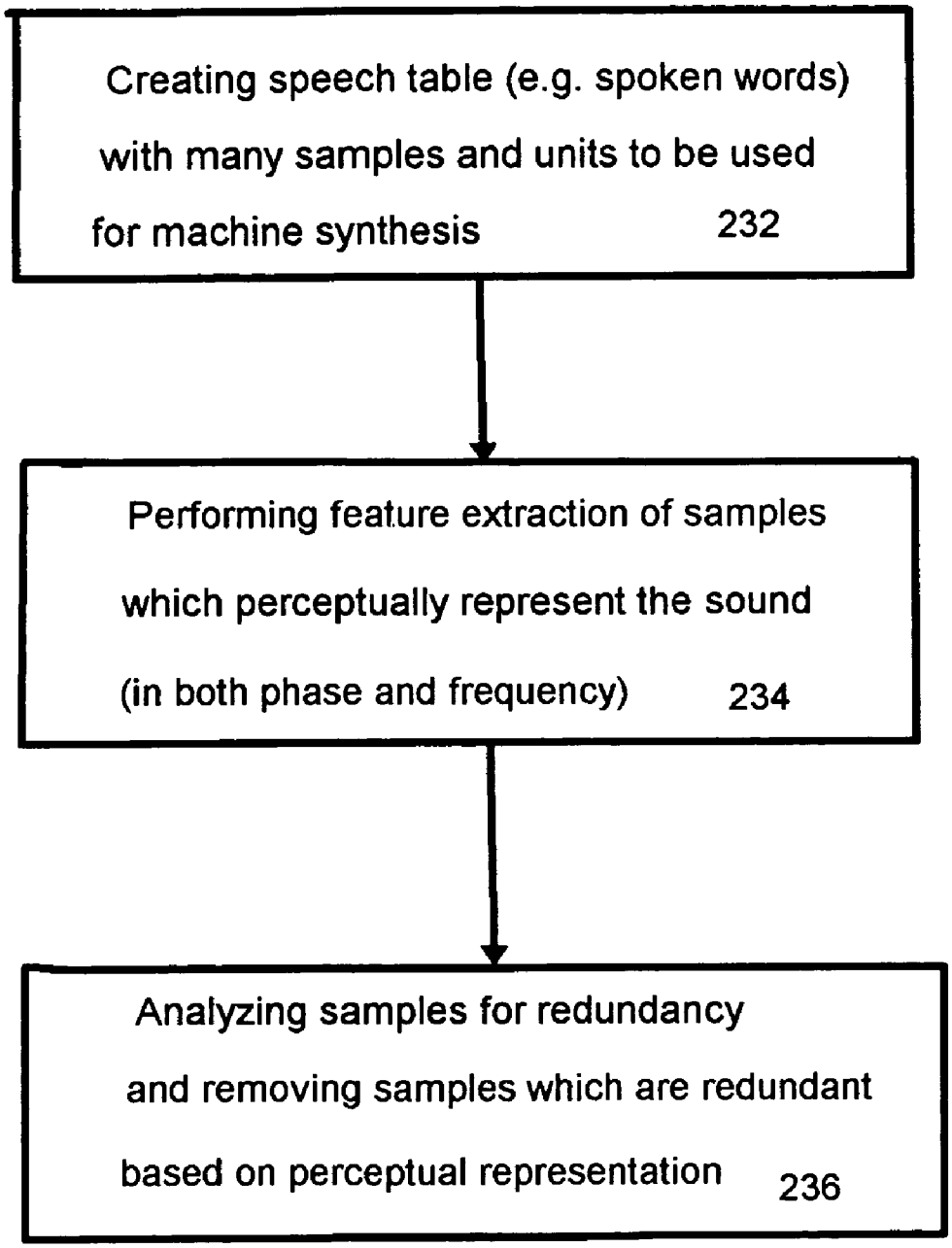
FIG. 5 shows a flow chart according to an embodiment of the present invention.

An exemplary method according to the present invention, shown in FIG. 5, comprises analyzing voice sample units for redundancy, and then removing units which are redundant or near-redundant based on a perceptual representation. The perceptual representation is preferably correlated, or highly correlated, to human perception, so that proximity in perceptual representation is correlated to proximity in human perception. Operation 232 shows the creation of a speech voice table with many units to be used for machine speech and synthesis. The voice table preferably comprises spoken voice segment units, such as phonemes, diphonemes, or words. The voice table preferably comprises voice segment units in sample waveforms for concatenative speech synthesis. Operation 234 performs feature extraction of units which perceptually represents the sound (e.g. perceptually represents sound units in both frequency and phase spaces) of each type. Operation 236 analyzes units for redundancy and removes units which are redundant based on the perceptual representation.

A particular embodiment of the invention is related to an alternative feature extraction based on singular value analysis which was recently used to measure the amount of discontinuity between two diphones, as well as to optimize the boundary between two diphones. In an embodiment, the present invention extends this feature extraction framework to voice (e.g. word) samples in a voice table.

Singular Value Decomposition technique is a preferred perceptual representation according to an embodiment for the present invention. In an exemplary implementation, the time-domain samples corresponding to all observed instances are gathered for the given word unit. This forms a matrix where each row corresponds to a particular instance present in the database. A matrix-style modal analysis via Singular Value Decomposition (SVD) is performed on the matrix. Each row of the matrix (i.e., instance of the unit) is then associated with a vector in the space spanned by the left and right singular matrices. These vectors can be viewed as feature vectors, which can then be clustered using an appropriate closeness measure. Pruning results by mapping each instance to the centroid of its cluster.

In Singular Value Decomposition techniques, there are three items to examine: how to form the input matrix, how to derive the feature space, and how to specify the clustering measure.

Figure 6:
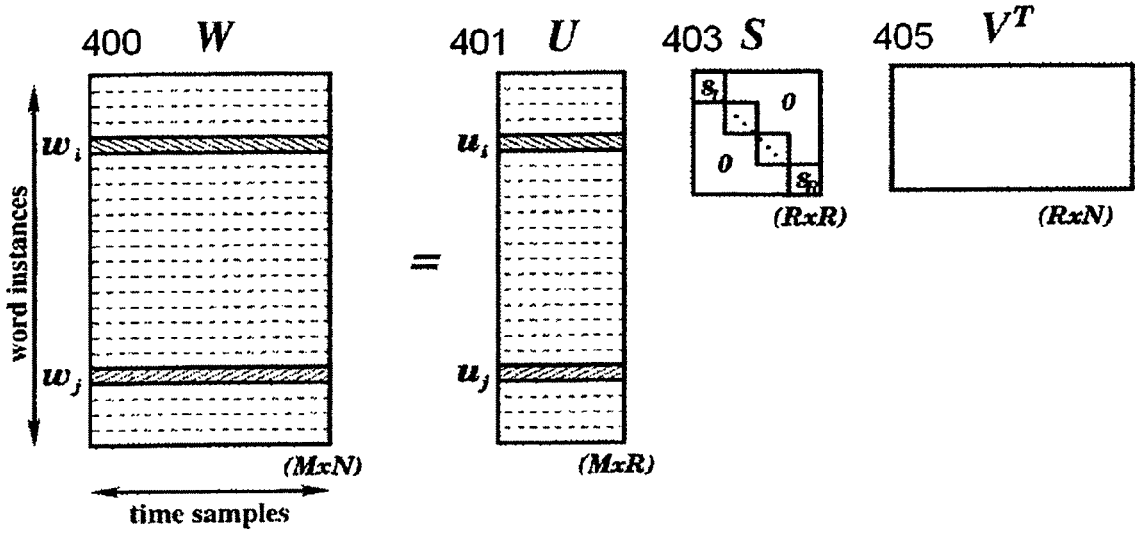
FIG. 6 illustrates an embodiment of the decomposition of an input matrix.

FIG. 6 shows an exemplary input matrix W. Assume that M instances of the word w are present in the voice table. For each instance, all time-domain observed samples are gathered. Let N denote the maximum number of samples observed across all instances. It is then possible to zero-pad all instances to N as necessary. The outcome is a (M×N) matrix W, where each row $w_1$ corresponds to a distinct instance of the word w, and each column corresponds to a slice of time samples. Typically, M and N are on the order of a few thousands to a few tens of thousands.

The feature vectors are derived from a Singular Value Decomposition (SVD) computation of the matrix W. In one embodiment, the feature vectors are derived by performing a matrix style modal analysis through a singular value decomposition (SVD) of the matrix W, as:

$$W=USV^T \tag{1}$$

where U is the (M×R) left singular matrix with row vectors $u_i$ ($1 \leqq i \leqq M$); S is the (R×R) diagonal matrix of singular values $s_1 \geqq s_2 \geqq s_3 \ldots \geqq s_R \geqq 0$; V is the (N×R) right singular matrix with row vectors $v_j$ ($1 \leqq j \leqq N$); R=min (M, N) is the order of the decomposition; and $^T$ denotes matrix transposition. The vector space of dimension R spanned by the $u_i$'s and $v_j$'s is referred to as the SVD space. In one embodiment, R is between 50 and 200.

FIG. 6 also illustrates an embodiment of the decomposition of the matrix W 400 into U 401, S 403 and $V^T$ 405. This (rank-R) decomposition defines a mapping between the set of instances $w_1$ of the word w and, after appropriate scaling by the singular values of S, the set of R-dimensional vectors $\bar{u}_i = u_i S$. The latter are the feature vectors resulting from the extraction mechanism. Since time-domain samples are used, both amplitude and phase information are retained, and in fact contribute simultaneously to the outcome. This mechanism takes a global view of the unit considered as reflected in the SVD vector space spanned by the resulting set of left and right singular vectors, since it draws information from every single instance observed in order to construct the SVD space. Indeed, the relative positions of the feature vectors is determined by the overall pattern of the time domain samples observed in the relevant instances, as opposed to any processing specific to a particular instance. Hence, two vectors $\bar{u}_i$ and $\bar{u}_j$ "close" (in some suitable metric) to one another can be expected to reflect a high degree of time domain similarity, and thus potentially a large amount of interchangeability.

Once appropriate feature vectors are extracted from matrix W, a distance or metric is determined between vectors as a measure of closeness between segments. In one embodiment, the cosine of the angle between two vectors is a natural metric to compare $\bar{u}_i$ and $\bar{u}_j$ in the SVD space. This results in a similarity or closeness measure:

$$C(\bar{u}_i, \bar{u}_j) = \cos(u_i S, u_j S) = \frac{u_i S^2 u_j^T}{\|u_i S\| \|u_j S\|} \tag{2}$$

for any $1 \leqq i, j \leqq M$. In other words, two vectors $\bar{u}_i$ and $\bar{u}_j$ with a high value of the measure (2) are considered closely related.

Once the closeness measure is specified, the word vectors in the SVD space are clustered, using any of a variety of standard algorithms. Since for some words w the number of such vectors may be large, it may be preferable to perform this clustering in stages, using, for example, K-means and bottom-up clustering sequentially. In that case, K-means clustering is used to obtain a coarse partition of the instances into a small set of superclusters. Each supercluster is then itself partitioned using bottom-up clustering. The outcome is a final set of clusters $C_k$, $1 \leqq k \leqq K$, where the ratio M/K defines the reduction factor achieved.

Proof of concept testing has been performed on an embodiment of the unsupervised unit pruning method. Preliminary experiments were conducted on a subset of the "Alex" voice table currently being developed on MacOS X, available from Apple Computer, Inc., the assignee of the present invention. The focus of these experiments was the word w=see. Specifically, M=8 instances of the word "see" are extracted from the voice table. The reason M is purposely limited to thus unusually low value was to keep the later analysis of every individual instance tractable. For each instance, all associated time-domain samples are gathered, and observed a maximum number of samples across all instances of N=10,721. This led to a (8×10,721) input matrix. SVD of this matrix is computed, and obtained the associated feature vectors as described in the previous section. Because of the low value of M, R=8 is used for the dimension of the SVD space in this exercise.

The word vectors are then clustered using bottom-up clustering. The outcome was 3 distinct clusters, for a reduction factor of 2.67. Each cluster was analyzed in detail for acoustico-linguistic similarities and differences. The first cluster is found to be predominantly contained instances of the word spoken with an accented vowel and a flat or failing pitch. The second cluster predominantly contained instances of the word spoken with an unaccented vowel and a rising pitch. Finally, the third cluster predominantly contained instances of the word spoken with a distinctly tense version of the vowel and a falling pitch. In all cases, it anecdotally felt that replacing one instance by another from the same cluster would largely maintain the "sound and feel" of the utterance, while replacing it by another from a different cluster would be seriously disruptive to the listener. This bodes well for the viability of the proposed approach when it comes to pruning near-redundant word units in concatenative text-to-speech synthesis.

Thus the voice table was able to be pruned in an unsupervised manner to achieve the relevant redundancy removal. In an embodiment, the disclosed pruned voice table is used in a data processing system, e.g. a TTS synthesis system, which comprises receiving a text input, and retrieving data from a pruned voice table. The pruned voice table preferably has redundant instances pruned according to a redundancy criterion based on a similarity measure of feature vectors. The data retrieved from the pruned voice table are preferably candidate speech units which can be concatenated together to provide a machine representation of the text input. In an exemplary, the text input is parsed into a sequence of phonetic data units, which then are matched with the pruned voice table to retrieve a list of candidate speech units. The candidate speech units are concatenated, and the resulting sequences are evaluated to find the best match for the text input.

The quality of the TTS synthesis typically depends on the availability of candidate speech units in the voice table. A large number of candidates provide a better chance of matching with prosodic and linguistic variations of the text input. However, redundancy is typically inherent in collecting information for a voice table, and redundant candidate speech units provide many disadvantages, ranging from large size data base, to the slow process of sorting through many redundant units.

The pruned voice table according to certain embodiments of the present invention provides an improved voice table. Additional prosodic and linguistic variations can be freely added to the disclosed pruned voice table with minimum concerns for redundancy, and thus the pruned voice table provides TTS synthesis variations without burdening the data processing system.

Figure 7A:
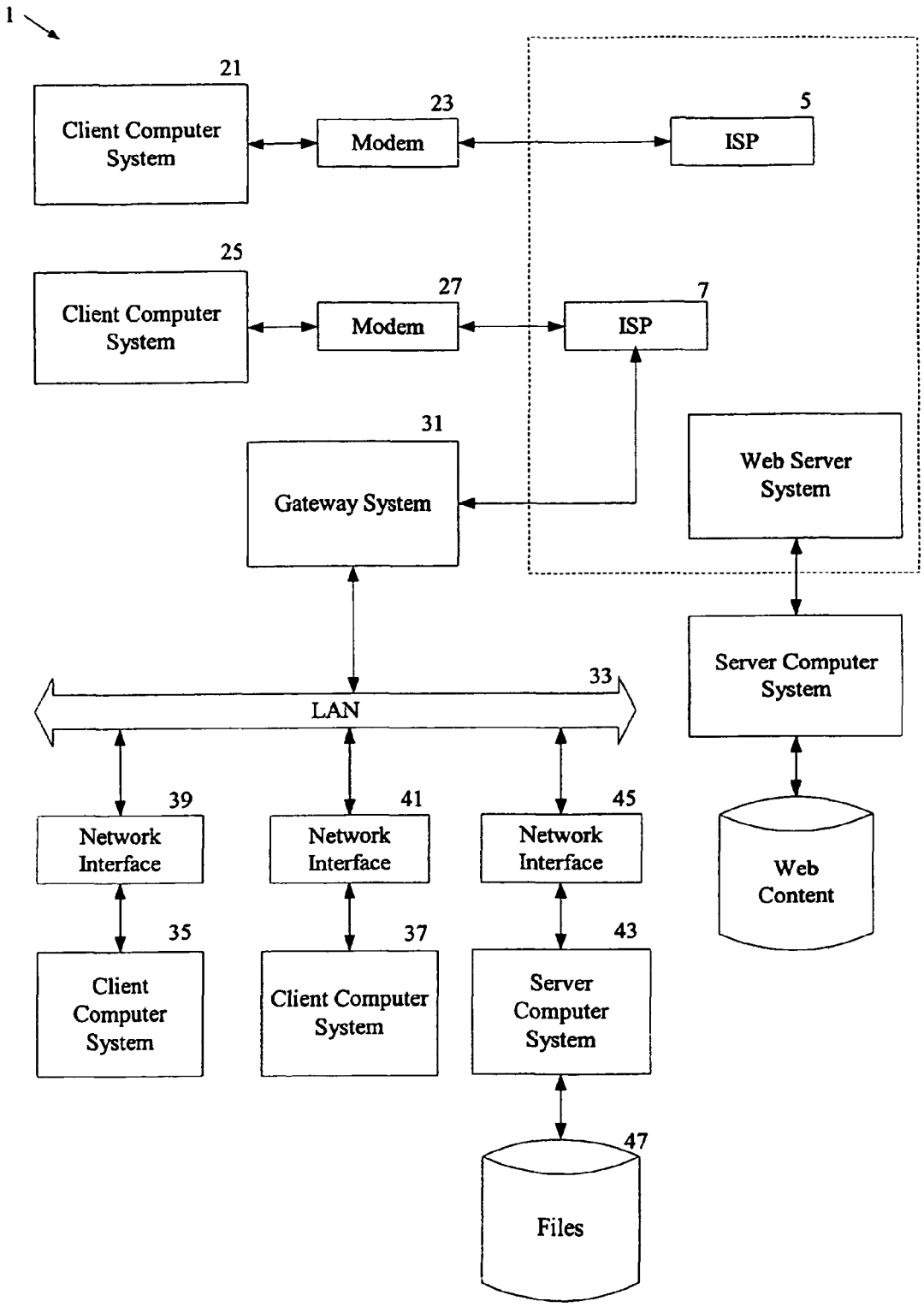
FIG. 7A is a diagram of one embodiment of an operating environment suitable for practicing the present invention.
Figure 7B:
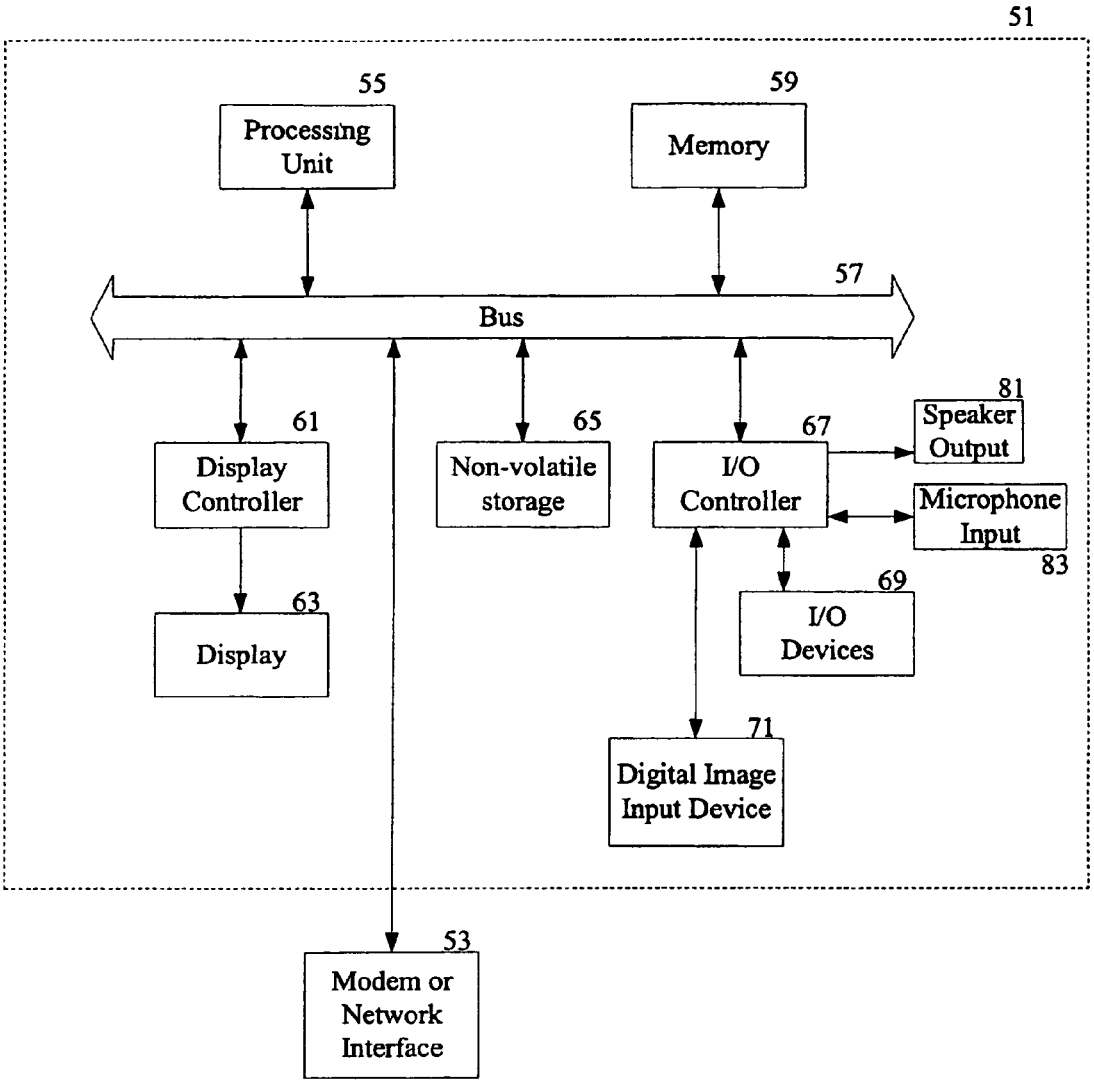
FIG. 7B is a diagram of one embodiment of a computer system suitable for use in the operating environment of FIG. 7A.

The following description of FIGS. 7A and 7B is intended to provide an overview of computer hardware and other operating components suitable for performing the methods of the invention described above, including the use of a pruned table to synthesize speech, but is not intended to limit the applicable environments. One of skill in the art will immediately appreciate that the invention can be practiced with other data processing system configurations, including hand-held devices, multiprocessor systems, microprocessor-based or programmable consumer electronics/appliances, network PCs, minicomputers, mainframe computers, and the like.

The invention can also be practiced in distributed computing environments where tasks are performed, at least in parts, by remote processing devices that are linked through a communications network.

FIG. 7A shows several computer systems 1 that are coupled together through a network 3, such as the Internet. The term "Internet" as used herein refers to a network of networks which uses certain protocols, such as the TCP/IP protocol, and possibly other protocols such as the hypertext transfer protocol (HTTP) for hypertext markup language (HTML) documents that make up the World Wide Web (web). The physical connections of the Internet and the protocols and communication procedures of the Internet are well known to those of skill in the art. Access to the Internet 3 is typically provided by Internet service providers (ISP), such as the ISPs 5 and 7. Users on client systems, such as client computer systems 21, 25, 35, and 37 obtain access to the Internet through the Internet service providers, such as ISPs 5 and 7. Access to the Internet allows users of the client computer systems to exchange information, receive and send e-mails, and view documents, such as documents which have been prepared in the HTML format. These documents are often provided by web servers, such as web server 9 which is considered to be "on" the Internet. Often these web servers are provided by the ISPs, such as ISP 5, although a computer system can be set up and connected to the Internet without that system being also an ISP as is well known in the art.

The web server 9 is typically at least one computer system which operates as a server computer system and is configured to operate with the protocols of the World Wide Web and is coupled to the Internet. Optionally, the web server 9 can be part of an ISP which provides access to the Internet for client systems. The web server 9 is shown coupled to the server computer system 11 which itself is coupled to web content 10, which can be considered a form of a media database. It will be appreciated that while two computer systems 9 and 11 are shown in FIG. 7A, the web server system 9 and the server computer system 11 can be one computer system having different software components providing the web server functionality and the server functionality provided by the server computer system 11 which will be described further below.

Client computer systems 21, 25, 35, and 37 can each, with the appropriate web browsing software, view HTML pages provided by the web server 9. The ISP 5 provides Internet connectivity to the client computer system 21 through the modem interface 23 which can be considered part of the client computer system 21. The client computer system can be a personal computer system, consumer electronics/appliance, an entertainment system (e.g. Sony Playstation or media player such as an iPod), a network computer, a personal digital assistant (PDA), a Web TV system, a handheld device, a cellular telephone, or other such data processing system. Similarly, the ISP 7 provides Internet connectivity for client systems 25, 35, and 37, although as shown in FIG. 7A, the connections are not the same for these three computer systems. Client computer system 25 is coupled through a modem interface 27 while client computer systems 35 and 37 are part of a LAN. While FIG. 7A shows the interfaces 23 and 27 as generically as a "modem," it will be appreciated that each of these interfaces can be an analog modem, ISDN modem, cable modem, satellite transmission interface, or other interfaces for coupling a computer system to other computer systems. Client computer systems 35 and 37 are coupled to a LAN 33 through network interfaces 39 and 41, which can be Ethernet network or other network interfaces. The LAN 33 is also coupled to a gateway computer system 31 which can provide firewall and other Internet related services for the local area network. This gateway computer system 31 is coupled to the ISP 7 to provide Internet connectivity to the client computer systems 35 and 37. The gateway computer system 31 can be a conventional server computer system. Also, the web server system 9 can be a conventional server computer system.

Alternatively, as well-known, a server computer system 43 can be directly coupled to the LAN 33 through a network interface 45 to provide files 47 and other services to the clients 35, 37, without the need to connect to the Internet through the gateway system 31. FIG. 7B shows one example of a conventional computer system that can be used as a client computer system or a server computer system or as a web server system. It will also be appreciated that such a computer system can be used to perform many of the functions of an Internet service provider, such as ISP 5. The computer system 51 interfaces to external systems through the modem or network interface 53. It will be appreciated that the modem or network interface 53 can be considered to be part of the computer system 51. This interface 53 can be an analog modem, ISDN modem, cable modem, token ring interface, satellite transmission interface, or other interfaces for coupling a computer system to other computer systems. The computer system 51 includes a processing unit 55, which can be a conventional microprocessor such as an Intel Pentium microprocessor or Motorola Power PC microprocessor. Memory 59 is coupled to the processor 55 by a bus 57. Memory 59 can be dynamic random access memory (DRAM) and can also include static RAM (SRAM). The bus 57 couples the processor 55 to the memory 59 and also to non-volatile storage 65 and to display controller 61 and to the input/output (I/O) controller 67. The display controller 61 controls in the conventional manner a display on a display device 63 which can be a cathode ray tube (CRT) or liquid crystal display (LCD). The input/output devices 69 can include a keyboard, disk drives, printers, a scanner, and other input and output devices, including a mouse or other pointing device. The display controller 61 and the I/O controller 67 can be implemented with conventional well known technology. A speaker output 81 (for driving a speaker) is coupled to the I/O controller 67, and a microphone input 83 (for recording audio inputs, such as the speech input 106) is also coupled to the I/O controller 67. A digital image input device 71 can be a digital camera which is coupled to an I/O controller 67 in order to allow images from the digital camera to be input into the computer system 51. The non-volatile storage 65 is often a magnetic hard disk, an optical disk, or another form of storage for large amounts of data. Some of this data is often written, by a direct memory access process, into memory 59 during execution of software in the computer system 51. One of skill in the art will immediately recognize that the terms "computer-readable medium" and "machine-readable medium" include any type of storage device that is accessible by the processor 55.

It will be appreciated that the computer system 51 is one example of many possible computer systems which have different architectures. For example, personal computers based on an Intel microprocessor often have multiple buses, one of which can be an input/output (I/O) bus for the peripherals and one that directly connects the processor 55 and the memory 59 (often referred to as a memory bus). The buses are connected together through bridge components that perform any necessary translation due to differing bus protocols.

Network computers are another type of computer system that can be used with the present invention. Network computers do not usually include a hard disk or other mass storage, and the executable programs are loaded from a network connection into the memory 59 for execution by the processor 55. A Web TV system, which is known in the art, is also considered to be a computer system according to the present invention, but it may lack some of the features shown in FIG. 7B, such as certain input or output devices. A typical data processing system will usually include at least a processor, memory, and a bus coupling the memory to the processor.

It will also be appreciated that the computer system 51 is controlled by operating system software which includes a file management system, such as a disk operating system, which is part of the operating system software. One example of an operating system software with its associated file management system software is the family of operating systems known as Mac® OS from Apple Computer, Inc. of Cupertino, Calif., and their associated file management systems. The file management system is typically stored in the non-volatile storage 65 and causes the processor 55 to execute the various acts required by the operating system to input and output data and to store data in memory, including storing files on the non-volatile storage 65.

The above description of illustrated embodiments of the invention, including what is described in the Abstract, is not intended to be exhaustive or to limit the invention to the precise forms disclosed. While specific embodiments of, and examples for, the invention are described herein for illustrative purposes, various equivalent modifications are possible within the scope of the invention, as those skilled in the relevant art will recognize. These modifications can be made to the invention in light of the above detailed description. The terms used in the following claims should not be construed to limit the invention to the specific embodiments disclosed in the specification and the claims. Rather, the scope of the invention is to be determined entirely by the following claims, which are to be construed in accordance with established doctrines of claim interpretation.

What is claimed is:

1. A machine-implemented method comprising:

pruning redundancy of instances in a plurality of speech segments, wherein the redundancy criterion is based on a similarity measure between feature vectors derived from a machine perception transformation of time-domain samples corresponding to the instances in the plurality of speech segments, wherein the instances subjected to redundancy pruning are clustered together with feature vectors discernably separated from each other in the machine perception transformation and wherein the machine perception transformation is correlated with human perception by using the time-domain samples retaining both amplitude and phase information of the speech segments, which were provided in sound data for a speech synthesis system.

2. The machine-implemented method of claim 1 wherein the instances are the instances of a phoneme, a diphone, a syllable, a word, or a sequence unit and wherein a first set of the instances subjected to redundancy pruning are clustered with a first feature vector and a second set of the instances subjected to redundancy pruning are clustered with a second feature vector that is discernably separated from the first feature vector.

3. The machine-implemented method of claim 1 wherein the feature vectors incorporate phase information of the instances.

4. The machine-implemented method of claim 1 wherein the plurality of speech segments are stored in a voice table.

5. The machine-implemented method of claim 1 further comprising:

recording speech input;

identifying the speech segments within the speech input; and identifying the instances within the speech segments.

6. The machine-implemented method of claim 1 wherein the feature vectors representing the instances are created by matrix-style modal analysis via singular value decomposition of a matrix W, wherein the matrix W is an M×N matrix where M is the number of instances, N is the maximum number of segment samples corresponding to an instance, with the matrix W being zero padded to N samples, wherein the singular value decomposition is represented by $$W=USV^T$$

where U is the M×R left singular matrix with row vectors $u_i$ ($1 \leqq i \leqq M$), S is the R×R diagonal matrix of singular values $s_1 \geqq s_2 \geqq \ldots \geqq s_R > 0$, V is the N×R right singular matrix with row vectors $v_j$ ($1 \leqq j \leqq N$), $R \leqq \min(M, N)$, and $^T$ denotes matrix transposition, wherein the feature vector $\bar{u}_i$ is calculated as $$\bar{u}_i = u_i S$$

where $u_i$ is a row vector associated with an instance i, and S is the singular diagonal matrix, and wherein the distance between two feature vectors is determined by a metric comprising a similarity measure, C, between two feature vectors, $\bar{u}_i$ and $\bar{u}_j$, wherein C is calculated as $$C(\bar{u}_i, \bar{u}_j) = \cos(u_i S, u_j S) = \frac{u_i S^2 u_j^T}{\|u_i S\| \|u_j S\|}$$

for any $1 \leqq i, j \leqq M$.

7. A machine-readable non-transitory storage medium having instructions to cause a machine to perform a machine-implemented method comprising:

pruning redundancy of instances in a plurality of speech segments, wherein the redundancy criterion is based on a similarity measure between feature vectors derived from a machine perception transformation of time-domain samples corresponding to the instances in the plurality of speech segments, wherein the instances subjected to redundancy pruning are clustered together with feature vectors discernably separated from each other in the machine perception transformation, wherein the machine perception transformation is correlated with human perception by using the time-domain samples retaining both amplitude and phase information of the speech segments, which were provided in sound data for a speech synthesis system, and wherein the redundancy pruning is performed on a representation of voice units, the representation being stored in a memory of a data processing system which includes a processor which performs the pruning.

8. The machine-readable medium of claim 7 wherein the instances are the instances of a phoneme, a diphone, a syllable, a word, or a sequence unit and wherein a first set of the instances subjected to redundancy pruning are clustered with a first feature vector and a second set of the instances subjected to redundancy pruning are clustered with a second feature vector that is discernably separated from the first feature vector.

9. The machine-readable medium of claim 7 wherein the feature vectors incorporate phase information of the instances.

10. The machine-readable medium of claim 7 wherein the plurality of speech segments are stored in a voice table.

11. The machine-readable medium of claim 7 wherein the method further comprises:

recording speech input;

identifying the speech segments within the speech input; and identifying the instances within the speech segments.

12. The machine-readable medium of claim 7 wherein the feature vectors representing the instances are created by matrix-style modal analysis via singular value decomposition of a matrix W, wherein the matrix W is an M×N matrix where M is the number of instances, N is the maximum number of segment samples corresponding to an instance, with the matrix W being zero padded to N samples, wherein the singular value decomposition is represented by $$W=USV^T$$

where U is the M×R left singular matrix with row vectors $u_i$ ($1 \leqq i \leqq M$), S is the R×R diagonal matrix of singular values $s_1 \geqq s_2 \geqq \ldots \geqq s_R > 0$, V is the N×R right singular matrix with row vectors $v_j$ ($1 \leqq j \leqq N$), $R \leqq \min(M, N)$, and $^T$ denotes matrix transposition, wherein the feature vector $\bar{u}_i$ is calculated as $$\bar{u}_i = u_i S$$

where $u_i$ is a row vector associated with an instance i, and S is the singular diagonal matrix, and wherein the distance between two feature vectors is determined by a metric comprising a similarity measure, C, between two feature vectors, $\bar{u}_i$ and $\bar{u}_j$, wherein C is calculated as $$C(\bar{u}_i, \bar{u}_j) = \cos(u_i S, u_j S) = \frac{u_i S^2 u_j^T}{\|u_i S\| \|u_j S\|}$$

for any $1 \leqq i, j \leqq M$.

13. An apparatus comprising:

means for automatically pruning redundancy of instances in a plurality of speech segments, wherein the redundancy criterion is based on a similarity measure between feature vectors derived from a machine perception transformation of time-domain samples corresponding to the instances in the plurality of speech segments, wherein the instances subjected to redundancy pruning are clustered together with feature vectors discernably separated from each other in the machine perception transformation and wherein the machine perception transformation is correlated with human perception by using the time-domain samples retaining both amplitude and phase information of the speech segments, which were provided in sound data for a speech synthesis system.

14. The apparatus of claim 13 wherein the instances are the instances of a phoneme, a diphone, a syllable, a word, or a sequence unit and wherein a first set of the instances subjected to redundancy pruning are clustered with a first feature vector and a second set of the instances subjected to redundancy pruning are clustered with a second feature vector that is discernably separated from the first feature vector.

15. The apparatus of claim 13 wherein the feature vectors incorporate phase information of the instances.

16. The apparatus of claim 13 wherein the plurality of speech segments are stored in a voice table.

17. The apparatus of claim 13 further comprising:

means for recording speech input;

means for identifying the speech segments within the speech input; and means for identifying the instances within the speech segments.

18. The apparatus of claim 13 wherein the feature vectors representing the instances are created by matrix-style modal analysis via singular value decomposition of a matrix W, wherein the matrix W is an M×N matrix where M is the number of instances, N is the maximum number of segment samples corresponding to an instance, with the matrix W being zero padded to N samples, wherein the singular value decomposition is represented by $$W = USV^T$$

where U is the M×R left singular matrix with row vectors $u_i$ ($1 \leqq i \leqq M$), S is the R×R diagonal matrix of singular values $s_1 \geqq s_2 \geqq \ldots \geqq s_R > 0$, V is the N×R right singular matrix with row vectors $v_j$ ($1 \leqq j \leqq N$), $R \leqq \min(M, N)$, and $^T$ denotes matrix transposition, wherein the feature vector $\bar{u}_i$ is calculated as $$\bar{u}_i = u_i S$$

where $u_i$ is a row vector associated with an instance i, and S is the singular diagonal matrix, and wherein the distance between two feature vectors is determined by a metric comprising a similarity measure, C, between two feature vectors, $\bar{u}_i$ and $\bar{u}_j$, wherein C is calculated as $$C(\bar{u}_i, \bar{u}_j) = \cos(u_i S, u_j S) = \frac{u_i S^2 u_j^T}{\|u_i S\| \|u_j S\|}$$

for any $1 \leqq i, j \leqq M$.

19. A system comprising:

a processing unit coupled to a memory through a bus; and a process executed from the memory by the processing unit to cause the processing unit to:

prune redundancy of instances in a plurality of speech segments, wherein the redundancy criterion is based on a similarity measure between feature vectors derived from a machine perception transformation of time-domain samples corresponding to the instances in the plurality of speech segments, wherein the instances subjected to redundancy pruning are clustered together with feature vectors discernably separated from each other in the machine perception transformation and wherein the machine perception transformation is correlated with human perception by using the time-domain samples retaining both amplitude and phase information of the speech segments, which were provided in sound data for a speech synthesis system.

20. The system of claim 19 wherein the instances are the instances of a phoneme, a diphone, a syllable, a word, or a sequence unit and wherein a first set of the instances subjected to redundancy pruning are clustered with a first feature vector and a second set of the instances subjected to redundancy pruning are clustered with a second feature vector that is discernably separated from the first feature vector.

21. The system of claim 19 wherein the feature vectors incorporate phase information of the instances.

22. The system of claim 19 wherein the plurality of speech segments are stored in a voice table.

23. The system of claim 19 wherein the process further causes the processing unit to:

record speech input;

identify the speech segments within the speech input; and identify the instances within the speech segments.

24. The system of claim 19 wherein the feature vectors representing the instances are created by matrix-style modal analysis via singular value decomposition of a matrix W, wherein the matrix W is an M×N matrix where M is the number of instances, N is the maximum number of segment samples corresponding to an instance, with the matrix W being zero padded to N samples, wherein the singular value decomposition is represented by $$W = USV^T$$

where U is the M×R left singular matrix with row vectors $u_i$ ($1 \leqq i \leqq M$), S is the R×R diagonal matrix of singular values $s_1 \geqq s_2 \geqq \ldots \geqq s_R > 0$, V is the N×R right singular matrix with row vectors $v_j$ ($1 \leqq j \leqq N$), $R \leqq \min(M, N)$, and $^T$ denotes matrix transposition, wherein the feature vector $\bar{u}_i$ is calculated as $$\bar{u}_i = u_i S$$

where $u_i$ is a row vector associated with an instance i, and S is the singular diagonal matrix, and wherein the distance between two feature vectors is determined by a metric comprising a similarity measure, C, between two feature vectors, $\bar{u}_i$ and $\bar{u}_j$ wherein C is calculated as $$C(\bar{u}_i, \bar{u}_j) = \cos(u_i S, u_j S) = \frac{u_i S^2 u_j^T}{\|u_i S\| \|u_j S\|}$$

for any $1 \leqq i, j \leqq M$.

25. A redundancy pruned voice table comprising a redundancy pruned voice table, wherein the voice table is pruned from an original voice table according to a machine-implemented method comprising:

pruning redundancy of instances in the original voice table, wherein the redundancy criterion is based on a similarity measure between feature vectors derived from a machine perception transformation of time-domain samples corresponding to the instances in the plurality of speech segments, wherein the instances subjected to redundancy pruning are clustered together with feature vectors discernably separated from each other in the machine perception transformation and wherein the machine perception transformation is correlated with human perception by using the time-domain samples retaining both amplitude and phase information of the speech segments, which were provided in sound data for a speech synthesis system.

26. The redundancy pruned voice table of claim 25 wherein the instances are the instances of a phoneme, a diphone, a syllable, a word, or a sequence unit and wherein a first set of the instances subjected to redundancy pruning are clustered with a first feature vector and a second set of the instances subjected to redundancy pruning are clustered with a second feature vector that is discernably separated from the first feature vector.

27. The redundancy pruned voice table of claim 25 wherein the feature vectors incorporate phase information of the instances.

28. The redundancy pruned voice table of claim 25 wherein the feature vectors representing the instances are created by matrix-style modal analysis via singular value decomposition of a matrix W, wherein the matrix W is an M×N matrix where M is the number of instances, N is the maximum number of segment samples corresponding to an instance, with the matrix W being zero padded to N samples, wherein the singular value decomposition is represented by $$W = USV^T$$

where U is the M×R left singular matrix with row vectors $u_i$ ($1 \leqq i \leqq M$), S is the R×R diagonal matrix of singular values $s_1 \geqq s_2 \geqq \ldots \geqq s_R > 0$, V is the N×R right singular matrix with row vectors $v_j$ ($1 \leqq j \leqq N$), $R \leqq \min(M, N)$, and $^T$ denotes matrix transposition, wherein the feature vector $\bar{u}_i$ is calculated as $$\bar{u}_i = u_i S$$

where $u_i$ is a row vector associated with an instance i, and S is the singular diagonal matrix, and wherein the distance between two feature vectors is determined by a metric comprising a similarity measure, C, between two feature vectors, $\bar{u}_i$ and $\bar{u}_j$, wherein C is calculated as $$C(\bar{u}_i, \bar{u}_j) = \cos(u_i S, u_j S) = \frac{u_i S^2 u_j^T}{\|u_i S\| \|u_j S\|}$$

for any $1 \leqq i, j \leqq M$.

29. A text-to-speech synthesis system comprising a redundancy pruned voice table, wherein the voice table is pruned from an original voice table according to a machine-implemented method comprising:

pruning redundancy of instances in the original voice table, wherein the redundancy criterion is based on a similarity measure between feature vectors derived from a machine perception transformation of time-domain samples corresponding to the instances in the plurality of speech segments, wherein the instances subjected to redundancy pruning are clustered together with feature vectors discernably separated from each other in the machine perception transformation and wherein the machine perception transformation is correlated with human perception by using the time-domain samples retaining both amplitude and phase information of the speech segments, which were provided in sound data for a speech synthesis system.

30. The text-to-speech synthesis system of claim 29 wherein the instances are the instances of a phoneme, a diphone, a syllable, a word, or a sequence unit and wherein a first set of the instances subjected to redundancy pruning are clustered with a first feature vector and a second set of the instances subjected to redundancy pruning are clustered with a second feature vector that is discernably separated from the first feature vector.

31. The text-to-speech synthesis system of claim 29 wherein the feature vectors incorporate phase information of the instances.

32. The text-to-speech synthesis system of claim 29 wherein the feature vectors representing the instances are created by matrix-style modal analysis via singular value decomposition of a matrix W, wherein the matrix W is an M×N matrix where M is the number of instances, N is the maximum number of segment samples corresponding to an instance, with the matrix W being zero padded to N samples, wherein the singular value decomposition is represented by $$W = USV^T$$

where U is the M×R left singular matrix with row vectors $u_i$ ($1 \leqq i \leqq M$), S is the R×R diagonal matrix of singular values $s_1 \geqq s_2 \geqq \ldots \geqq s_R > 0$, V is the N×R right singular matrix with row vectors $v_j$ ($1 \leqq j \leqq N$), $R \leqq \min(M, N)$, and $^T$ denotes matrix transposition, wherein the feature vector $\bar{u}_i$ is calculated as $$\bar{u}_i = u_i S$$

where $u_i$ is a row vector associated with an instance i, and S is the singular diagonal matrix, and wherein the distance between two feature vectors is determined by a metric comprising a similarity measure, C, between two feature vectors, $\bar{u}_i$ and $\bar{u}_j$, wherein C is calculated as $$C(\bar{u}_i, \bar{u}_j) = \cos(u_i S, u_j S) = \frac{u_i S^2 u_j^T}{\|u_i S\| \|u_j S\|}$$

for any $1 \leqq i, j \leqq M$.

33. A machine-implemented method comprising:

identifying instances in a plurality of speech segments;

creating feature vectors derived from a machine perception transformation of time-domain samples corresponding to the instances in the plurality of speech segments onto a feature space, wherein the machine perception transformation is correlated with human perception by using the time-domain samples retaining both amplitude and phase information of the speech segments, which were provided in sound data for a speech synthesis system;

clustering the feature vectors using a similarity measure in the feature space; and replacing the clustered instances corresponding to the clustered feature vectors within a radius by a single instance.

34. The machine-implemented method of claim 33 wherein the instances are the instances of a phoneme, a diphone, a syllable, a word, or a sequence unit.

35. The machine-implemented method of claim 33 wherein the feature vectors incorporate phase information of the instances.

36. The machine-implemented method of claim 33 wherein the plurality of speech segments are stored in a voice table.

37. The machine-implemented method of claim 33 further comprising:

recording speech input; and identifying the speech segments within the speech input.

38. The machine-implemented method of claim 33 wherein the cluster radius is controlled by a user.

39. The machine-implemented method of claim 33 wherein the single instance is the instance corresponding to the centroid of the feature vector cluster.

40. The machine-implemented method of claim 33 wherein creating feature vectors comprises:

constructing a matrix W from the instances; and decomposing the matrix W.

41. The machine-implemented method of claim 40 wherein the matrix W is an M×N matrix where M is the number of instances, N is the maximum number of segment samples corresponding to an instance, wherein constructing the matrix W comprises inputting the numbers of segment samples corresponding to the instances.

42. The machine-implemented method of claim 41 wherein the matrix W is zero padded to N samples.

43. The machine-implemented method of claim 40 wherein decomposing the matrix W comprises performing a singular value decomposition of W, represented by $$W = USV^T$$

where M is the number of instances, M is the maximum number of segments corresponding to an instance, U is the M×R left singular matrix with row vectors $u_i$ ($1 \leqq i \leqq M$), S is the R×R diagonal matrix of singular values $s_1 \geqq s_2 \geqq \ldots \geqq s_R > 0$, V is the N×R right singular matrix with row vectors $v_j$ ($1 \leqq j \leqq N$), $R \leqq \min(M, N)$, and $^T$ denotes matrix transposition.

44. The machine-implemented method of claim 43 wherein a feature vector $\bar{u}_i$ is calculated as $$\bar{u}_i = u_i S$$

where $u_i$ is a row vector associated with an instance i, and S is the singular diagonal matrix.

45. The machine-implemented method of claim 44 wherein the distance between two feature vectors is determined by a metric comprising a similarity measure, C, between two feature vectors, $\bar{u}_i$ and $\bar{u}_j$, wherein C is calculated as $$C(\bar{u}_i, \bar{u}_j) = \cos(u_i S, u_j S) = \frac{u_i S^2 u_j^T}{\|u_i S\| \|u_j S\|}$$

for any $1 \leqq i, j \leqq M$.

46. The machine-implemented method of claim 33 wherein the clustering process comprises a sequentially clustering process, wherein the sequentially clustering process comprises a coarse partition into a set of superclusters, and a fine partition of the superclusters into a set of clusters.

47. A machine-readable non-transitory storage medium having instructions to cause a machine to perform a machine-implemented method comprising:

identifying instances in a plurality of speech segments;

creating feature vectors derived from a machine perception transformation of time-domain samples corresponding to the instances in the plurality of speech segments onto a feature space, wherein the machine perception transformation is correlated with human perception by using the time-domain samples retaining both amplitude and phase information of the speech segments, which were provided in sound data for a speech synthesis system;

clustering the feature vectors using a similarity measure in the feature space; and replacing the clustered instances corresponding to the clustered feature vectors within a radius by a single instance, wherein the identifying instances, the creating feature vectors, the clustering feature vectors, and the replacing clustered instances are performed on a representation of speech segments, the representation being stored in a memory of a data processing system which includes a processor which performs the pruning.

48. The machine-readable medium of claim 47 wherein the instances are the instances of a phoneme, a diphone, a syllable, a word, or a sequence unit.

49. The machine-readable medium of claim 47 wherein the feature vectors incorporate phase information of the instances.

50. The machine-readable medium of claim 47 wherein the plurality of speech segments are stored in a voice table.

51. The machine-readable medium of claim 47 wherein the method further comprises:

recording speech input; and identifying the speech segments within the speech input.

52. The machine-readable medium of claim 47 wherein the cluster radius is controlled by a user.

53. The machine-readable medium of claim 47 wherein the single instance is the instance corresponding to the centroid of the feature vector cluster.

54. The machine-readable medium of claim 47 wherein creating feature vectors comprises:

constructing a matrix W from the instances; and decomposing the matrix W.

55. The machine-readable medium of claim 54 wherein the matrix W is an M×N matrix where M is the number of instances, N is the maximum number of segment samples corresponding to an instance, wherein constructing the matrix W comprises inputting the numbers of segment samples corresponding to the instances.

56. The machine-readable medium of claim 55 wherein the matrix W is zero padded to N samples.

57. The machine-readable medium of claim 54 wherein decomposing the matrix W comprises performing a singular value decomposition of W, represented by $$W=USV^T$$

where M is the number of instances, M is the maximum number of segments corresponding to an instance, U is the M×R left singular matrix with row vectors $u_i$ ($1 \leqq i \leqq M$), S is the R×R diagonal matrix of singular values $s_1 \geqq s_2 \geqq \ldots \geqq s_R > 0$, V is the N×R right singular matrix with row vectors $v_j$ ($1 \leqq j \leqq N$), $R \leqq \min(M, N)$, and $^T$ denotes matrix transposition.

58. The machine-readable medium of claim 57 wherein a feature vector $\bar{u}_i$ is calculated as $$\bar{u}_i u_i S$$

where u, is a row vector associated with an instance i, and S is the singular diagonal matrix.

59. The machine-readable medium of claim 58 wherein the distance between two feature vectors is determined by a metric comprising a similarity measure, C, between two feature vectors, $\bar{u}_i$ and $\bar{u}_j$, wherein C is calculated as $$C(\bar{u}_i, \bar{u}_j) = \cos(u_i S, u_j S) = \frac{u_i S^2 u_j^T}{\|u_i S\| \|u_j S\|}$$

for any $1 \leqq i, j \leqq M$.

60. The machine-readable medium of claim 47 wherein the clustering process comprises a sequentially clustering process, wherein the sequentially clustering process comprises a coarse partition into a set of superclusters, and a fine partition of the superclusters into a set of clusters.

61. An apparatus comprising:

means for identifying instances in a plurality of speech segments;

means for creating feature vectors derived from a machine perception transformation of time-domain samples corresponding to the instances in the plurality of speech segments onto a feature space, wherein the machine perception transformation is correlated with human perception by using the time-domain samples retaining both amplitude and phase information of the speech segments, which were provided in sound data for a speech synthesis system;

means for clustering the feature vectors using a similarity measure in the feature space; and means for replacing the clustered instances corresponding to the clustered feature vectors within a radius by a single instance.

62. The apparatus of claim 61 wherein the instances are the instances of a phoneme, a diphone, a syllable, a word, or a sequence unit.

63. The apparatus of claim 61 wherein the feature vectors incorporate phase information of the instances.

64. The apparatus of claim 61 wherein the plurality of speech segments are stored in a voice table.

65. The apparatus of claim 61 further comprising:

means for recording speech input; and means for identifying the speech segments within the speech input.

66. The apparatus of claim 61 wherein the cluster radius is controlled by a user.

67. The apparatus of claim 61 wherein the single instance is the instance corresponding to the centroid of the feature vector cluster.

68. The apparatus of claim 61 wherein creating feature vectors comprises:

constructing a matrix W from the instances; and decomposing the matrix W.

69. The apparatus of claim 68 wherein the matrix W is an M×N matrix where M is the number of instances, N is the maximum number of segment samples corresponding to an instance, wherein constructing the matrix W comprises inputting the numbers of segment samples corresponding to the instances.

70. The apparatus of claim 69 wherein the matrix W is zero padded to N samples.

71. The apparatus of claim 68 wherein decomposing the matrix W comprises performing a singular value decomposition of W, represented by $$W=USV^T$$

where M is the number of instances, M is the maximum number of segments corresponding to an instance, U is the M×R left singular matrix with row vectors $u_i$ ($1 \leqq i \leqq M$), S is the R×R diagonal matrix of singular values $s_1 \geqq s_2 \geqq \ldots \geqq s_R > 0$, V is the N×R right singular matrix with row vectors $v_j$ ($1 \leqq j \leqq N$), $R \leqq \min(M, N)$, and $^T$ denotes matrix transposition.

72. The apparatus of claim 71 wherein a feature vector is calculated as $$\bar{u}_i = u_i S$$

where $u_i$ is a row vector associated with an instance i, and S is the singular diagonal matrix.

73. The apparatus of claim 72 wherein the distance between two feature vectors is determined by a metric comprising a similarity measure, C, between two feature vectors, $\bar{u}_i$ and $\bar{u}_j$, wherein C is calculated as $$C(\bar{u}_i, \bar{u}_j) = \cos(u_i S, u_j S) = \frac{u_i S^2 u_j^T}{\|u_i S\| \|u_j S\|}$$

for any $1 \leqq i, j \leqq M$.

74. The apparatus of claim 61 wherein the clustering process comprises a sequentially clustering process, wherein the sequentially clustering process comprises a coarse partition into a set of superclusters, and a fine partition of the superclusters into a set of clusters.

75. A system comprising:

a processing unit coupled to a memory through a bus; and a process executed from the memory by the processing unit to cause the processing unit to:

identify instances in a plurality of speech segments;

create feature vectors derived from a machine perception transformation of time-domain samples corresponding to the instances in the plurality of speech segments onto a feature space, wherein the machine perception transformation is correlated with human perception by using the time-domain samples retaining both amplitude and phase information of the speech segments, which were provided in sound data for a speech synthesis system;

cluster the feature vectors using a similarity measure in the feature space; and replace the clustered instances corresponding to the clustered feature vectors within a radius by a single instance.

76. The system of claim 75 wherein the instances are the instances of a phoneme, a diphone, a syllable, a word, or a sequence unit.

77. The system of claim 75 wherein the feature vectors incorporate phase information of the instances.

78. The system of claim 75 wherein the plurality of speech segments are stored in a voice table.

79. The system of claim 75 wherein the process further causes the processing unit to:

recording speech input; and identifying the speech segments within the speech input.

80. The system of claim 75 wherein the cluster radius is controlled by a user.

81. The system of claim 75 wherein the single instance is the instance corresponding to the centroid of the feature vector cluster.

82. The system of claim 75 wherein creating feature vectors comprises:

constructing a matrix W from the instances; and decomposing the matrix W.

83. The system of claim 82 wherein the matrix W is an M×N matrix where M is the number of instances, N is the maximum number of segment samples corresponding to an instance, wherein constructing the matrix W comprises inputting the numbers of segment samples corresponding to the instances.

84. The system of claim 83 wherein the matrix W is zero padded to N samples.

85. The system of claim 82 wherein decomposing the matrix W comprises performing a singular value decomposition of W, represented by $$W=USV^T$$

where M is the number of instances, M is the maximum number of segments corresponding to an instance, U is the M×R left singular matrix with row vectors $u_i$ ($1 \leqq i \leqq M$), S is the R×R diagonal matrix of singular values $s_1 \geqq s_2 \geqq \ldots \geqq s_R > 0$, V is the N×R right singular matrix with row vectors $v_j$ ($1 \leqq j \leqq N$), $R \leqq \min(M, N)$, and $^T$ denotes matrix transposition.

86. The system of claim 85 wherein a feature vector is calculated as $$\bar{u}_i = u_i S$$

where $u_i$ is a row vector associated with an instance i, and S is the singular diagonal matrix.

87. The system of claim 86 wherein the distance between two feature vectors is determined by a metric comprising a similarity measure, C, between two feature vectors, $\bar{u}_i$ and $\bar{u}_j$, wherein C is calculated as $$C(\bar{u}_i, \bar{u}_j) = \cos(u_i S, u_j S) = \frac{u_i S^2 u_j^T}{\|u_i S\| \|u_j S\|}$$

for any $1 \leqq i, j \leqq M$.

88. The system of claim 75 wherein the clustering process comprises a sequentially clustering process, wherein the sequentially clustering process comprises a coarse partition into a set of superclusters, and a fine partition of the superclusters into a set of clusters.

89. A voice table for use in a text-to-speech synthesis system, wherein the voice table is pruned from an original voice table according to a machine-implemented method comprising:

identifying instances in the original voice table;

creating feature vectors derived from a machine perception transformation of time-domain samples corresponding to the instances of speech segments in the original voice table onto a feature space, wherein the machine perception transformation is correlated with human perception by using the time-domain samples retaining both amplitude and phase information of the speech segments, which were provided in sound data for a speech synthesis system;

clustering the feature vectors using a similarity measure in the feature space; and replacing the clustered instances corresponding to the clustered feature vectors within a radius by a single instance.

90. The voice table of claim 89 wherein the instances are the instances of a phoneme, a diphone, a syllable, a word, or a sequence unit.

91. The voice table of claim 89 wherein the feature vectors incorporate phase information of the instances.

92. The voice table of claim 89 wherein the cluster radius is controlled by a user.

93. The voice table of claim 89 wherein the single instance is the instance corresponding to the centroid of the feature vector cluster.

94. The voice table of claim 89 wherein the feature vectors represent the instances are created by matrix-style modal analysis via singular value decomposition of a matrix W, wherein the matrix W is an M×N matrix where M is the number of instances, N is the maximum number of segment samples corresponding to an instance, with the matrix W being zero padded to N samples, wherein the singular value decomposition is represented by $$W=USV^T$$

where U is the M×R left singular matrix with row vectors $u_i$ ($1 \leqq i \leqq M$), S is the R×R diagonal matrix of singular values $s_1 \geqq s_2 \geqq \ldots \geqq s_R > 0$, V is the N×R right singular matrix with row vectors $v_j$ ($1 \leqq j \leqq N$), $R \leqq \min(M, N)$, and $^T$ denotes matrix transposition, wherein the feature vector $\bar{u}_i$ is calculated as $$\bar{u}_i = u_i S$$

where $u_i$ is a row vector associated with an instance i, and S is the singular diagonal matrix, and wherein the distance between two feature vectors is determined by a metric comprising a similarity measure, C, between two feature vectors, $\bar{u}_i$ and $\bar{u}_j$, wherein C is calculated as $$C(\bar{u}_i, \bar{u}_j) = \cos(u_i S, u_j S) = \frac{u_i S^2 u_j^T}{\|u_i S\| \|u_j S\|}$$

for any $1 \leqq i, j \leqq M$.

95. A text-to-speech synthesis system comprising a voice table, wherein the voice table is pruned from an original voice table according to a machine-implemented method comprising:

identifying instances in the original voice table;

creating feature vectors derived from a machine perception transformation of time-domain samples corresponding to the instances of speech segments in the original voice table onto a feature space, wherein the machine perception transformation is correlated with human perception by using the time-domain samples retaining both amplitude and phase information of the speech segments;

clustering the feature vectors using a similarity measure in the feature space; and replacing the clustered instances corresponding to the clustered feature vectors within a radius by a single instance.

96. The text-to-speech synthesis system of claim 95 wherein the instances are the instances of a phoneme, a diphone, a syllable, a word, or a sequence unit.

97. The text-to-speech synthesis system of claim 95 wherein the feature vectors incorporate phase information of the instances.

98. The text-to-speech synthesis system of claim 95 wherein the cluster radius is controlled by a user.

99. The text-to-speech synthesis system of claim 95 wherein the single instance is the instance corresponding to the centroid of the feature vector cluster.

100. The text-to-speech synthesis system of claim 95 wherein the feature vectors represent the instances are created by matrix-style modal analysis via singular value decomposition of a matrix W, wherein the matrix W is an M×N matrix where M is the number of instances, N is the maximum number of segment samples corresponding to an instance, with the matrix W being zero padded to N samples, wherein the singular value decomposition is represented by $$W=USV^T$$

where U is the M×R left singular matrix with row vectors $u_i$ ($1 \leqq i \leqq M$), S is the R×R diagonal matrix of singular values $s_1 \geqq s_2 \geqq \ldots \geqq s_R > 0$, V is the N×R right singular matrix with row vectors $v_j$ ($1 \leqq j \leqq N$), $R \leqq \min(M, N)$, and $^T$ denotes matrix transposition, wherein the feature vector $\bar{u}_i$ is calculated as $$\bar{u}_i = u_i S$$

where $u_i$ is a row vector associated with an instance i, and S is the singular diagonal matrix, and wherein the distance between two feature vectors is determined by a metric comprising a similarity measure, C, between two feature vectors, $\bar{u}_i$ and $\bar{u}_j$, wherein C is calculated as $$C(\bar{u}_i, \bar{u}_j) = \cos(u_i S, u_j S) = \frac{u_i S^2 u_j^T}{\|u_i S\| \|u_j S\|}$$

for any $1 \leqq i, j \leqq M$.

101. A machine readable non-transitory storage medium containing executable instructions which when executed by a machine cause the machine to perform a method comprising:

receiving an input which comprises text;

retrieving data from a voice table, stored in a machine readable medium, the voice table having redundant instances pruned according to a redundancy criterion based on a similarity measure between feature vectors derived from a machine perception transformation of time-domain samples corresponding to the instances of speech segments in the voice table, wherein the machine perception transformation is correlated with human perception by using the time-domain samples retaining both amplitude and phase information of the speech segments which were provided in sound data for a speech synthesis system, and wherein the data retrieving is performed on a representation of voice units, the representation being stored in a memory of a data processing system which includes a processor which performs the data retrieving.

102. A medium as in claim 101 wherein clustered instances are represented by a representative instance and wherein the redundancy criterion is based at least in part on phase information.

* * * * *